US012044435B2

(12) United States Patent
Kajiyama

(10) Patent No.: US 12,044,435 B2
(45) Date of Patent: Jul. 23, 2024

(54) LIQUID-RETAINABLE DEVICE FOR HUMIDIFIER

(71) Applicant: Panasonic Intellectual Property Management Co., Ltd., Osaka (JP)

(72) Inventor: Kenichi Kajiyama, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 414 days.

(21) Appl. No.: 16/797,737

(22) Filed: Feb. 21, 2020

(65) Prior Publication Data

US 2020/0271338 A1 Aug. 27, 2020

Related U.S. Application Data

(60) Provisional application No. 62/810,386, filed on Feb. 26, 2019.

(51) Int. Cl.

| | |
|---|---|
| ***F24F 6/04*** | (2006.01) |
| *F24F 6/00* | (2006.01) |
| *F24F 13/02* | (2006.01) |

(52) U.S. Cl.

CPC ..... *F24F 6/04* (2013.01); *F24F 6/043* (2013.01); *F24F 2006/008* (2013.01); *F24F 13/0254* (2013.01); *F24F 13/0272* (2013.01)

(58) Field of Classification Search

CPC ..... F24F 6/02; F24F 6/04; F24F 6/043; F24F 2006/008; F24F 13/28; F24F 13/0254; F24F 13/0272

See application file for complete search history.

(56) References Cited

U.S. PATENT DOCUMENTS 3,276,754 A * 10/1966 Skerritt ..... F24F 6/043 261/104
3,877,356 A * 4/1975 Bruns ..... F24F 13/06 454/299
5,061,405 A 10/1991 Stanek et al.

(Continued)

FOREIGN PATENT DOCUMENTS

JP 1-63943 4/1989
JP 2004-270964 9/2004

(Continued)

*Primary Examiner* — Jerry-Daryl Fletcher
*Assistant Examiner* — Daniel C Comings
(74) *Attorney, Agent, or Firm* — Wenderoth, Lind & Ponack, L.L.P.

(57) ABSTRACT

A liquid-retainable device includes a device body capable of accommodating a liquid, a first ventilation part, a second ventilation part, a partition part, and a humidification filter. The first ventilation part includes a first hole passing through a wall surface of the device body, and being configured to introduce air. The second ventilation part includes a second hole passing through the wall surface of the device body, and being configured to let out the air. The partition part divides an interior of the device body into a first region, which is a region for accommodating the liquid, and a second region, which is a region for forming an air flow path between the first ventilation part and the second ventilation part. The humidification filter is arranged so as to extend from the first region to the second region.

16 Claims, 11 Drawing Sheets

(56) References Cited

U.S. PATENT DOCUMENTS

| | | | | |
|---|---|---|---|---|
| 6,022,271 | A * | 2/2000 | Biondo | A62C 2/242 454/369 |
| 2007/0157928 | A1* | 7/2007 | Pujol | A61M 16/109 261/119.1 |
| 2008/0006953 | A1* | 1/2008 | Won | F24F 6/043 261/DIG. 65 |
| 2016/0035518 | A1* | 2/2016 | Pawar | H02B 1/56 218/157 |
| 2016/0305675 | A1* | 10/2016 | Terlson | F24F 6/043 |

FOREIGN PATENT DOCUMENTS

| | | | | |
|---|---|---|---|---|
| JP | 2005-315554 | | 11/2005 | |
| JP | 2011-241993 | | 12/2011 | |
| JP | 2014-55682 | | 3/2014 | |
| JP | 2015-25568 | | 2/2015 | |
| WO | WO-9942764 | A1 * | 8/1999 | F24F 6/043 |
| WO | WO-2015145888 | A1 * | 10/2015 | F24F 6/04 |
| WO | WO-2018026891 | A1 * | 2/2018 | F24F 13/00 |

* cited by examiner

LIQUID-RETAINABLE DEVICE FOR HUMIDIFIER

CROSS-REFERENCE TO RELATED APPLICATION

This application claims benefit to U.S. provisional application No. 62/810,386, filed on Feb. 26, 2019. The entire disclosure of U.S. provisional application No. 62/810,386 is hereby incorporated herein by reference.

1. TECHNICAL FIELD

The present disclosure relates to a liquid-retaining device for a humidifying apparatus.

2. BACKGROUND ART

In a humidifying apparatus or air purifier, a water-retaining container to accommodate water is provided in order to humidify air. Water-retaining containers that are detachable for purposes of water supply are known (for example, see Japanese Patent Publication No. 2014-55682).

BRIEF SUMMARY

When a detachable water-retaining container was removed in order to supply water, there was a possibility that water could spill from the water-retaining container. For example, inside an aircraft or in another such environment, vibration is constantly generated while the aircraft is moving, and there are cases where it is impossible to maintain a horizontal state during takeoff and landing. Therefore, water inside the water-retaining container would undulate or leap upward, whereby it was possible for the water to leak out from the water-retaining container and there was a risk of electrical leakage, short-circuiting, etc., in surrounding electronic equipment.

The present disclosure provides a liquid-retaining device that is effective in preventing liquid leakage, and a humidifying apparatus equipped with the liquid-retaining device.

The liquid-retaining device according to the present disclosure comprises a device body capable of accommodating a liquid, a first ventilation part, a second ventilation part, a partition part, and a humidifying filter. The first ventilation part includes a first hole passing through a wall surface of the device body, the first hole configured to introduce air. The second ventilation part includes a second hole passing through the wall surface of the device body, the second hole configured to lead out the air. The partition part divides an interior of the device body into a first region and a second region, the first region being a region for accommodating the liquid, the second region being a region to form an air flow path between the first ventilation part and the second ventilation part. The humidifying filter is arranged so as to extend from the first region to the second region.

The humidifying apparatus according to the present disclosure comprises the liquid-retaining device, a body part to which the liquid-retaining device can be attached, an airflow generator that is arranged in the body part, the airflow generator configured to generate an airflow passing through the air flow path, and a discharge opening that is arranged in the body part, the discharge opening configured to discharge humidified air through the air flow path.

DESCRIPTION OF EMBODIMENTS

Embodiments are described in detail below with reference to appropriate drawings. Detailed description may be omitted where such description is unnecessary. For example, detailed description of matters that are already well known, or repeated descriptions for configurations that are substantially identical, may be omitted.

The accompanying drawings and the following description are provided in order for a person skilled in the art to sufficiently understand the present disclosure, and are not intended to thereby limit the subject matters disclosed in the claims.

In the following description, a Z-axis direction is described as a vertical direction, with a positive side of a Z axis being upward and a negative side of the Z axis being downward, for purposes of convenience; however, the Z-axis direction is not limited thereto because modes for attaching an electrostatic atomization apparatus 1 are varied. Unless otherwise noted, the negative direction of the Z axis may also not denote a direction of gravity.

In the following embodiments, electrostatic atomization in an electrostatic atomization apparatus, which is one example of a humidifying apparatus, involves cooling a water application electrode and causing moisture in air to condense on the water application electrode, thereby generating charged particulate water. An electrode-cooling-type electrostatic atomization method not requiring a direct supply of water is used for the water application electrode.

1. Embodiment 1

1-1. Configuration

1-1-1. Configuration of Electrostatic Atomization Apparatus 1

Figure 1:
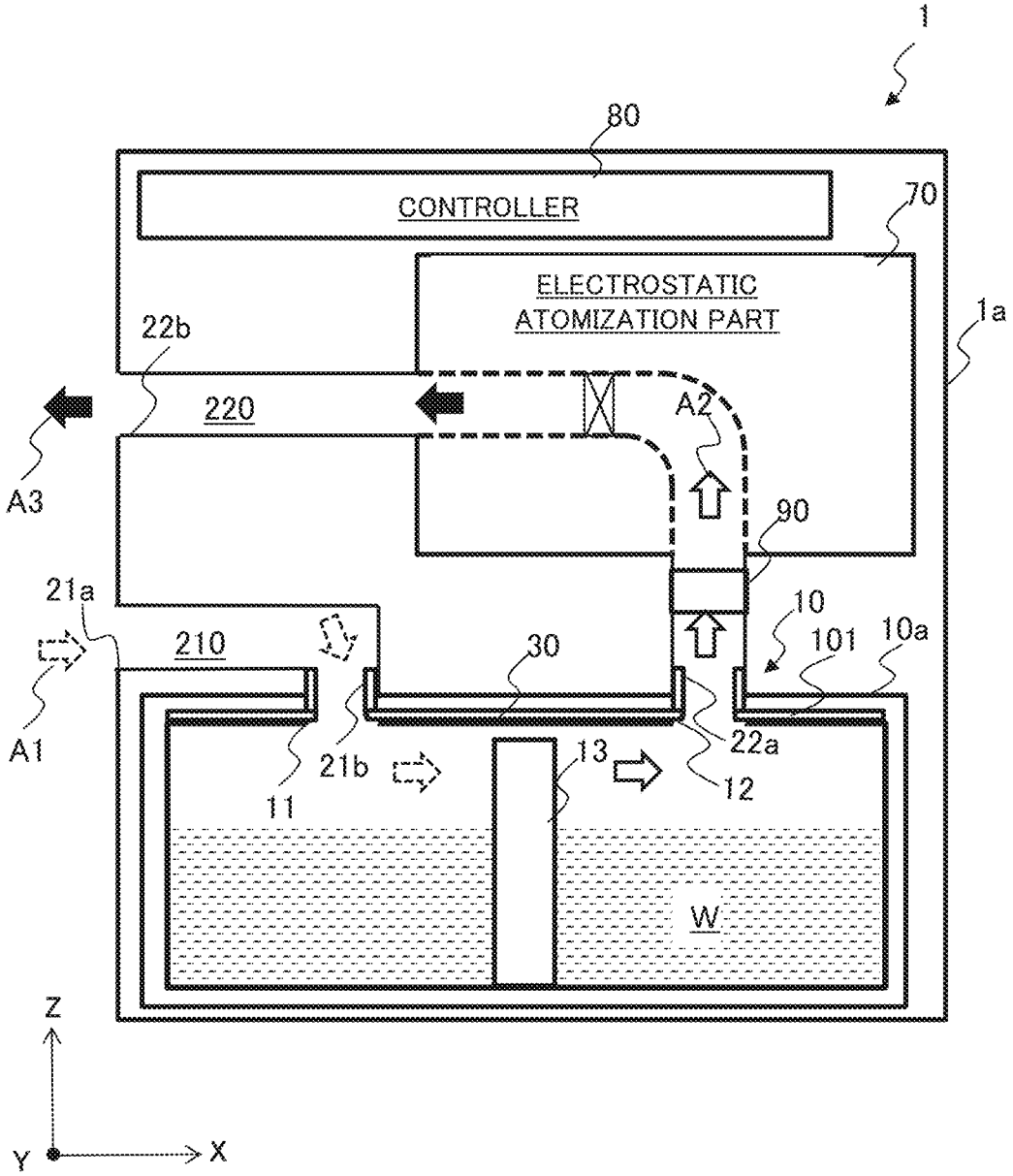
FIG. 1 shows a basic configuration of an electrostatic atomization apparatus in Embodiment 1.

As shown in FIG. 1, an electrostatic atomization apparatus 1 (one example of a humidifying apparatus) comprises a body part 1*a*, a water-retaining container 10, a first air flow path 210, a second air flow path 220, a duct member 30, an electrostatic atomization part 70, a controller 80, and a fan 90. The electrostatic atomization apparatus 1 further comprises a container detachment mechanism 50 described below.

The body part 1*a* is a casing and accommodates the water-retaining container 10, the first air flow path 210, the second air flow path 220, the electrostatic atomization part 70, the controller 80, and the fan 90.

The water-retaining container 10 (one example of a liquid-retaining device) has a container body 10*a* to retain water. The water-retaining container 10 has a first ventilation hole 11 and a second ventilation hole 12 in an upper surface (Z-axis-positive-direction-side surface) of the container body 10*a*. The first ventilation hole 11 (one example of a first ventilation part) forms a path for taking air before being humidified into the container body 10*a*. The second ventilation hole 12 (one example of a second ventilation part) forms a path for sending humidified air out from the container body 10*a* to the electrostatic atomization part 70. In the present embodiment, the ventilation holes 11, 12 are positioned in an upper part 101 of the container body 10*a* so that water W inside the container body 10*a* does not spill. The ventilation holes 11, 12 are also formed in a sufficiently small size so that the water W inside the container body 10*a* does not spill. For example, the ventilation holes 11, 12 are 0.1 to 2 $cm^2$ in size. Each of the ventilation holes 11, 12 may optionally be configured from a plurality of small holes.

The upper part 101 of the container body 10*a* may optionally be a sealable lid. A user can open the upper part 101 of the container body 10*a* when removing the water-retaining container 10 from the electrostatic atomization apparatus 1 and refilling the container body 10*a* with the water W.

In the present embodiment, the first ventilation hole 11 and the second ventilation hole 12 are provided in the upper part of the container body 10*a* so that the water W inside the container does not readily spill; however, this configuration is not essential to achieving the object of the present invention. The ventilation holes 11, 12 may instead be provided in a side surface of the container body 10*a*, provided that the location is such that the water W does not spill.

The water-retaining container 10 further comprises a humidifying filter 13 inside the container body 10*a*. The humidifying filter 13 is installed in an upright manner between the first ventilation hole 11 and the second ventilation hole 12 (midway along an X-axis direction). This disposition enables the humidifying filter 13 to efficiently supply moisture to low-humidity air taken in from the outside and to generate high-humidity air.

The humidifying filter 13 humidifies low-humidity air that has flowed in from the first ventilation hole 11. The humidifying filter 13 is, for example, a corrugated humidifying filter, suctioning moisture held by the container body 10*a* and holding this moisture. In this state, low-humidity air passes through gaps in the humidifying filter 13, whereby moisture evaporates from a surface inside the humidifying filter 13, the air is humidified, and high-humidity air is generated. The humidifying filter 13 has fire-retardancy and does not readily burn even when fire is present inside an aircraft. The humidifying filter 13 may also optionally have resistance to corrosion. The refilled water W evaporates slowly in the humidifying filter 13, therefore enabling continuous electrostatic atomization during a long flight.

The first air flow path 210 extends from a first end, which is an air intake opening 21*a*, to a second end 21*b* connected to the first ventilation hole 11 in the water-retaining container 10. The first air flow path 210 takes in air from the air intake opening 21*a* in accordance with the flow of an airflow generated by the fan 90, and passes the air to the first ventilation hole 11 in the water-retaining container 10. The air that is taken in is low-humidity air A1 that is insufficient to generate condensation water.

The second air flow path 220 extends from a third end 22*a* connected to the second ventilation hole 12 in the water-retaining container 10 to a fourth end, which is an air discharge opening 22*b* (one example of a discharge opening). The second air flow path 220 sends air A2 that has been humidified in the water-retaining container 10 from the second ventilation hole 12 to the electrostatic atomization part 70 in accordance with the flow of the airflow generated by the fan 90. The second air flow path 220 furthermore sends out air A3 that contains charged particulate water generated by the electrostatic atomization part 70 to the discharge opening 22*b*, and releases the air A3 to the outside.

Figure 2:
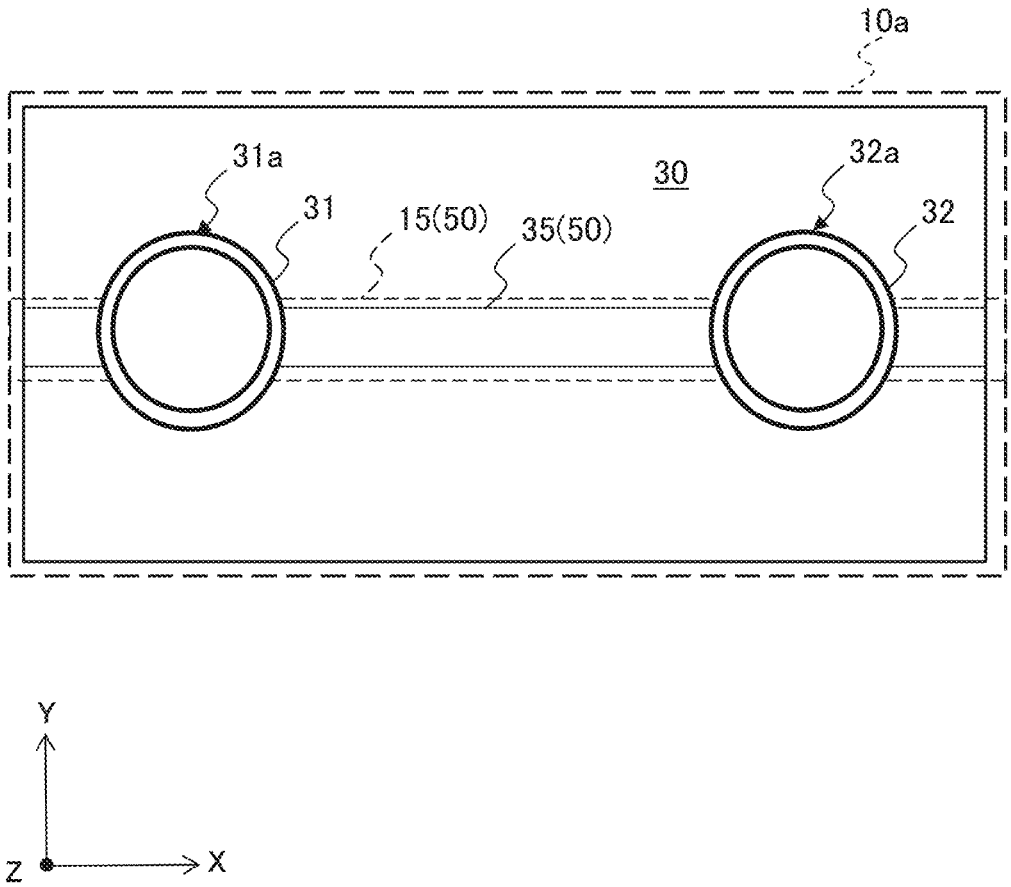
FIG. 2 is a top view of a duct member in Embodiment 1.
Figure 3:
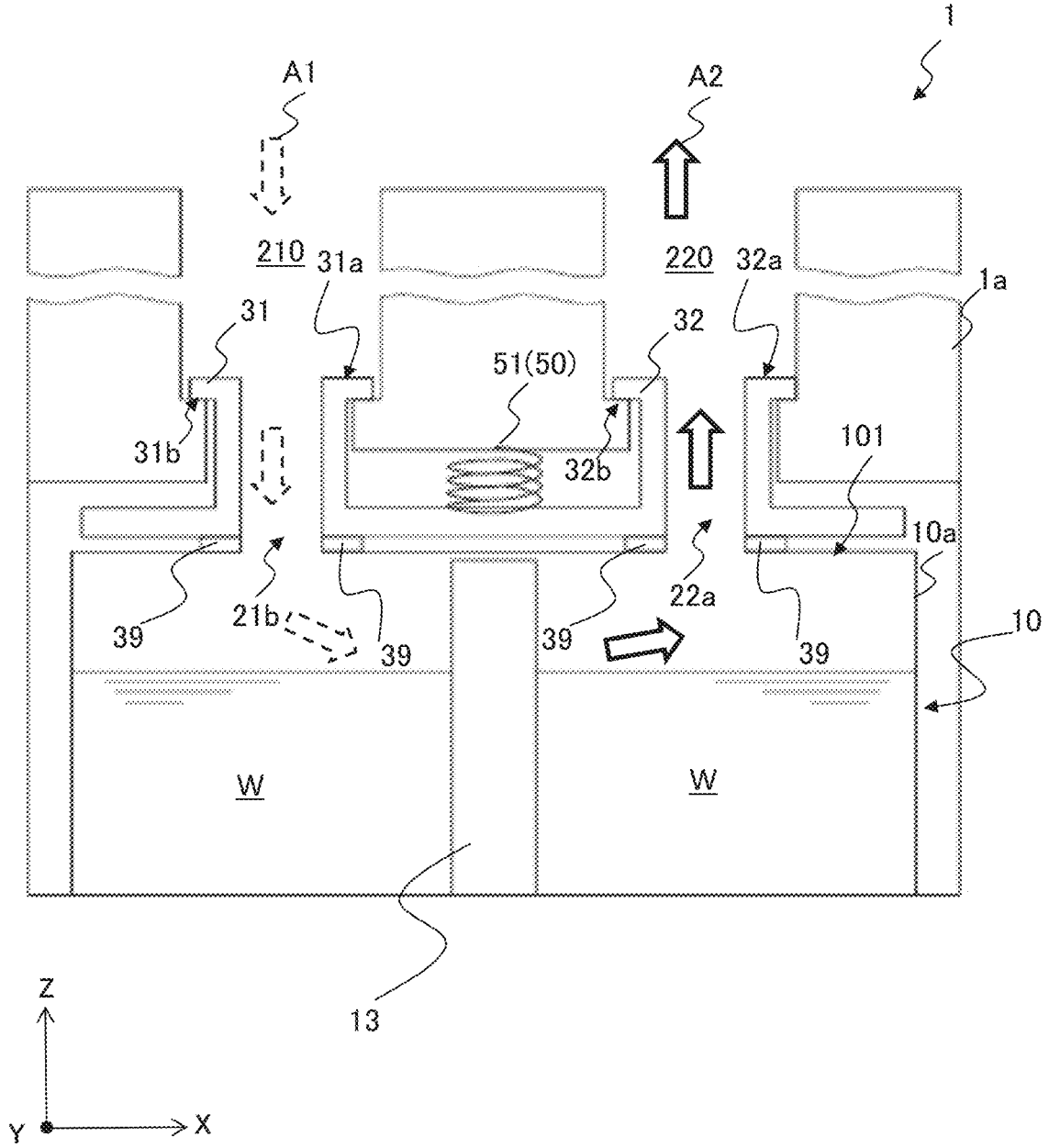
FIG. 3 shows a state in which a water-retaining container is attached to the electrostatic atomization apparatus in Embodiment 1.
Figure 5:
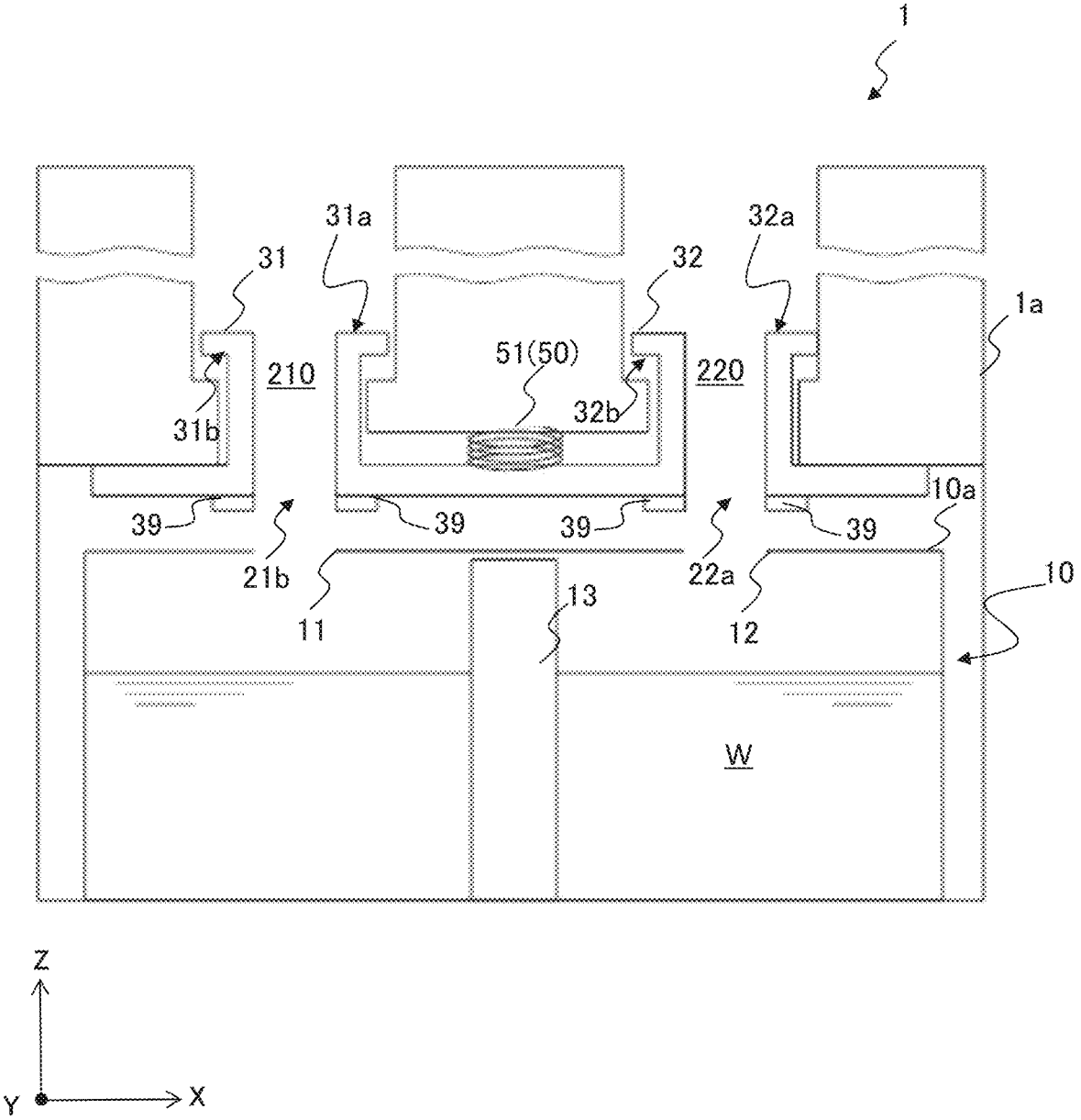
FIG. 5 shows a state in which the water-retaining container is removed from the electrostatic atomization apparatus in Embodiment 1.

The duct member 30 (one example of a connection part) is an integrally molded article and has a first duct 31 and a second duct 32, as shown in FIG. 2. The first duct 31 connects the body part 1*a* and the first ventilation hole 11 in the water-retaining container 10, and forms a part of the first air flow path 210. The second duct 32 connects the body part 1*a* and the second ventilation hole 12 in the water-retaining container 10, and forms a part of the second air flow path 220. Each of the first duct 31 and the second duct 32 has an open end 31*a*, 32*a* having a hook-shaped cross-section, as shown in FIGS. 3 and 5. Each of the open ends 31*a*, 32*a* has an abutting surface 31*b*, 32*b* that is oriented toward the water-retaining-container 10 attached to the body part 1*a*. The abutting surfaces 31*b*, 32*b* abut step parts formed at corresponding portions of the body part 1*a*. Specifically, the duct member 30 and the body part 1*a* have a configuration in which these elements abut each other at surfaces in a direction intersecting an airflow direction, or a direction substantially orthogonal to the airflow direction. Therefore, a structure can be formed in which the water W inside the water-retaining container 10 does not readily leak from a boundary portion between the duct member 30 and the body part 1*a*.

The electrostatic atomization part 70 is arranged above the second air flow path 220. The electrostatic atomization part 70 is provided with, for example, a cooling part, a water application electrode, and a counter electrode (none of which are shown), as is well known. A high voltage is applied to the water application electrode and the counter electrode, and the cooling part cools the water application electrode. Condensation thereby occurs on the electrode due to moisture in the high-humidity air A2, and charged particulate water is generated. The air A3 that contains the charged particulate water is released to the outside by the discharge opening 22*b*.

The controller 80 includes, for example, a processor such as a central processing unit (CPU). The controller 80 controls operations of, for example, the electrostatic atomization part 70 and the fan 90 described below in accordance with a program stored in a memory.

The fan 90 (one example of an airflow generator) generates an airflow to cause air to pass from the first air flow path 210 to the second air flow path 220 through the inside of the water-retaining container 10. The air is sent to the intake opening 21*a*, the first air flow path 210, the water-retaining container 10, the electrostatic atomization part 70, and the discharge opening 22*b* by the running of the fan 90. The fan 90 is not limited to being arranged at the position shown in FIG. 1, and may optionally be arranged at a position close to the intake opening 21*a* or at a position preceding the discharge opening 22*b*. The airflow-generator is not limited to being the fan 90, and another means or method to generate an airflow may optionally be used.

1-1-2. Configuration of Container Detachment Mechanism

A variety of equipment is mounted in the limited space within an aircraft. It is possible that this mounted equipment includes electronic equipment that would break down due to immersion or submersion or the like in water or adhesion of water droplets. The electrostatic atomization apparatus 1 of the present disclosure is equipment that handles water and requires operations to replenish water periodically occur, and therefore, the water-retaining container 10 has a structure that is detachable from the body part 1*a* of the electrostatic atomization apparatus 1. However, the electrostatic atomization apparatus 1 of the present disclosure is installed inside an aircraft, and is therefore exposed to vibrations from various directions during operation. Due to these vibrations, the water-retaining container 10 could accidentally become detached from the body part 1*a* of the electrostatic atomization apparatus 1 and cause water leakage.

A container detachment mechanism 50, which is shown in FIGS. 3 to 6 and is described below, is provided to the electrostatic atomization apparatus 1 according to the present embodiment, thereby making it less likely for water leakage caused by the water-retaining container 10 accidentally becoming detached from the body part 1*a* of the electrostatic atomization apparatus to occur.

The container detachment mechanism 50 causes the duct member 30 to move upward and downward relative to the water-retaining container 10, and brings about a state in which the duct member 30 is in pressing contact with the water-retaining container 10 when the water-retaining container 10 is attached to the body part 1*a*. Specifically, the container detachment mechanism 50 is provided with a spring 51 arranged between the body part 1*a* and the duct member 30, a protruding part 35 formed in a lower part of the duct member 30, and a recessed part 15 formed in an upper part 101 of the container body 10*a*, as shown in FIGS. 3 to 6.

Figure 4:
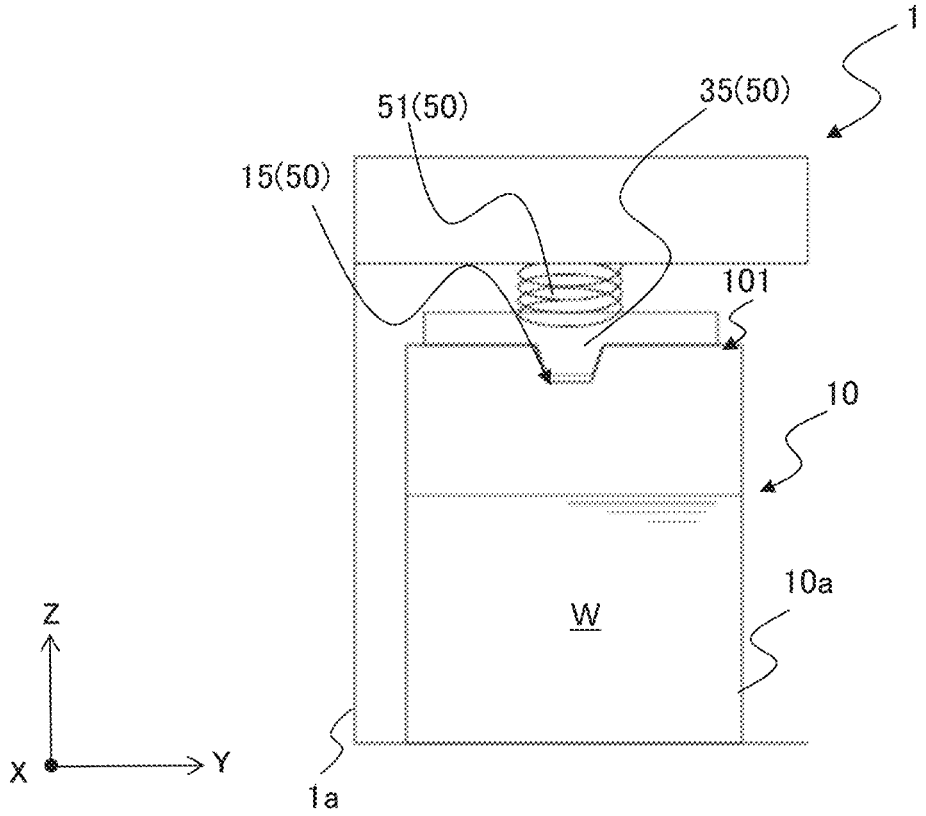
FIG. 4 is a cross-sectional view showing the electrostatic atomization apparatus in FIG. 3 from a different direction.

FIGS. 3 and 4 show a state in which the water-retaining container 10 is fitted onto the body part 1*a*, i.e., a state in which the electrostatic atomization apparatus 1 can operate. FIG. 4 shows a YZ cross-section of the water-retaining container 10 in FIG. 3. The spring 51 has an urging force on the water-retaining-container 10 side, i.e., in the negative direction of the Z axis. The protruding part 35 protrudes from a lower (Z-axis-negative-side) surface of the duct member 30, as shown in FIG. 4. The recessed part 15 is formed in the upper part 101 of the container body 10*a* and is recessed in the negative direction of the Z axis. As shown in FIG. 2, the protruding part 35 and the recessed part 15 are formed so as to be long in the X-axis direction along a longitudinal direction of the container body 10*a*. In a state in which the water-retaining container 10 is fitted onto the body part 1*a*, the protruding part 35 is accommodated in the recessed part 15 and the two parts are engaged. At this time, the spring 51 becomes compressed in the positive direction of the Z axis against the urging force. Due to the urging force of the spring 51, the duct member 30 and the water-retaining container 10 are closely fitted, and the protruding part 35 and the recessed part 15 are engaged. Therefore, the position of the water-retaining container 10 does not readily become misaligned even under a given amount of vibration. Thus, it is possible to prevent the water-retaining container 10 from becoming detached, etc., from the duct member 30, and to prevent water leakage from occurring.

Alternatively, the recessed part may be provided to the duct member 30, and the protruding part may be provided on the water-retaining-container 10.

A cushion material 39 is arranged between the duct member 30 and the water-retaining container 10. The cushion material 39 is arranged between the first duct 31 and a periphery of the first ventilation hole 11, and between the second duct 32 and a periphery of the second ventilation hole 12. The cushion material 39 improves close-fitting properties between the water-retaining container 10 and the duct member 30, therefore making it possible to effectively prevent water leakage.

1-2. Operation

1-2-1. Operation of Electrostatic Atomization Apparatus

In an electrostatic atomization method performed by the electrostatic atomization apparatus 1 according to Embodiment 1, the air A1 taken in from the intake opening 21*a* passes through the first air flow path 210 and is taken into the water-retaining container 10, in which the water W is accommodated, due to the airflow generated by the fan 90, as shown in FIG. 1. The air A1 is humidified by passing through the inside of the water-retaining container 10. The humidified air A2 is discharged from the water-retaining container 10. The moisture in the humidified air A2 is caused to condense on the electrode to which voltage is applied in the electrostatic atomization part 70, thereby generating charged particulate water. The air A3 that contains the charged particulate water is discharged from the discharge opening 22*b*.

Figure 6:
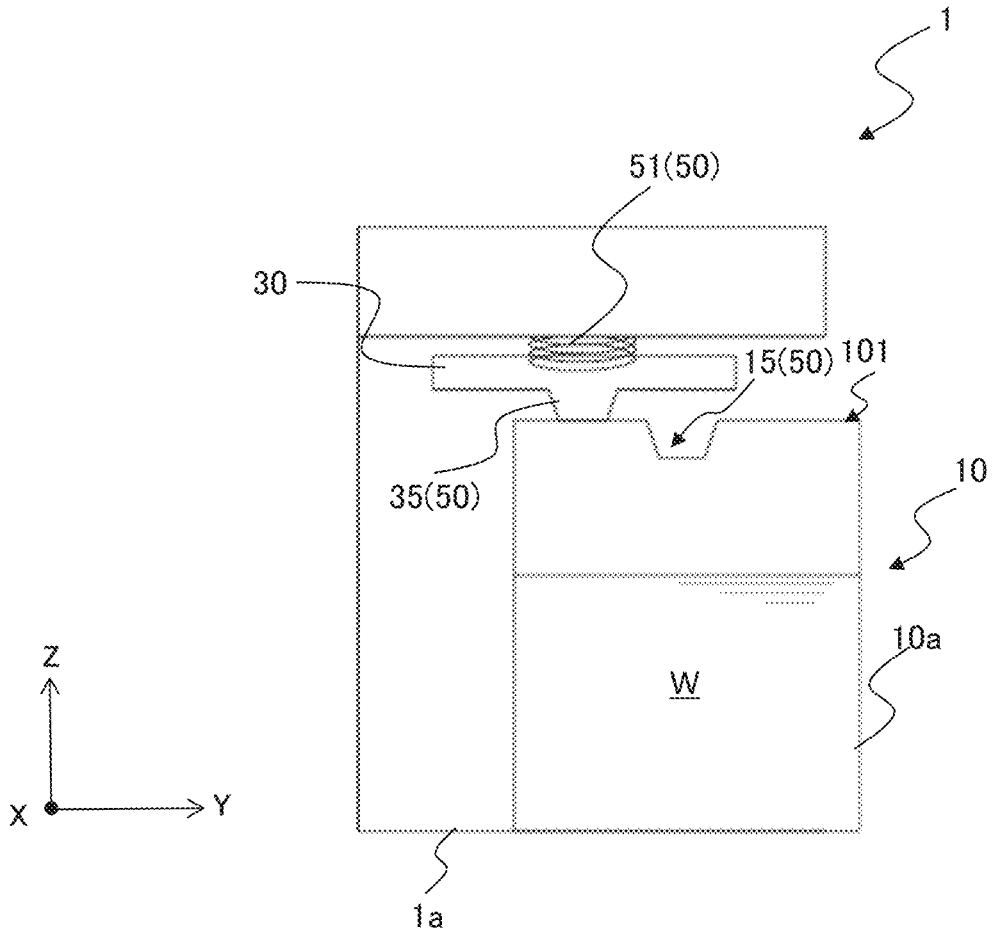
FIG. 6 is a cross-sectional view showing the electrostatic atomization apparatus in FIG. 5 from a different direction.

1-2-2. Detachment Operation of Container Attachment and Detachment Mechanism FIGS. 5 and 6 show a state in which the water-retaining container 10 is removed from the body part 1*a*, i.e., a state in which the electrostatic atomization apparatus 1 is not operating. In FIG. 6, when the water-retaining container 10 is pulled out in a positive direction of a Y axis, the protruding part 35 of the duct member 30 separates from the recessed part 15 in the upper surface of the container body 10*a* and travels upward onto a flat portion that is a different surface from the recessed part in the upper surface. As a result, the duct member 30 is pushed in the positive direction of the Z axis and pushes the spring 51 upward, and the spring 51 is therefore further compressed against the urging force. When the water-retaining container 10 is pulled out further in the positive direction of the Y axis, the water-retaining container 10 separates from the duct member 30 and can be removed from the body part 1*a*. When the water-retaining container 10 is removed, the duct member 30 moves in the negative direction of the Z axis due to the urging force of the spring 51 or due to the weight of the duct member 30. After refilled with the water W, the water-retaining container 10 is attached to the body part 1*a*. At this time, as shown in FIG. 6, when the water-retaining container 10 is pushed in a negative direction of the Y axis, the duct member 30 is pushed upward and travels upward onto the upper surface of the container body 10*a* against the urging force of the spring 51. When the water-retaining container 10 is pushed further in the negative direction of the Y axis, the protruding part 35 fits into the recessed part 15. As a result, as shown in FIGS. 3 and 4, the water-retaining container 10 is attached to the body part 1*a*.

1-3. Characteristics

Conventionally, in low-humidity environments such as an interior of aircraft flying through the sky at high altitude, a level of humidity necessary to produce condensation water could not be reached, and the condensation water could not be obtained. Alternatively, there were also cases in which the condensation water would freeze due to strong cooling of a heat-absorbing surface, and the condensation water still could not be obtained. As a result, a problem was presented in that electrostatic atomization could not be performed.

In the electrostatic atomization apparatus 1 or the electrostatic atomization method according to Embodiment 1, the low-humidity air A1 taken in from the air intake opening 21*a* is caused to pass through an interior of the water-retaining container 10 and is humidified, the humidified air A2 is caused to pass through the electrostatic atomization part 70, and air A3 that contains charged particulate water is discharged. Therefore, even when outside air that is taken in has low humidity, humidified air can constantly be sent to the electrostatic atomization part 70. Thus, it is possible to produce the condensation water necessary for electrostatic atomization, and to perform electrostatic atomization even in low-humidity environments.

The electrostatic atomization apparatus 1 according to Embodiment 1 comprises the duct member 30 and the container detachment mechanism 50. The duct member 30 has the first duct 31, which is connected to the first ventilation hole 11 and forms a part of the first air flow path 210, and the second duct 32, which is connected to the second ventilation hole 12 and forms a part of the second air flow path 220. The container detachment mechanism 50 brings the duct member 30 into pressing contact with the water-retaining container 10 attached to the body part 1*a*. Therefore, during the running of the electrostatic atomization apparatus 1, it is possible to prevent water leakage from the water-retaining container 10 even when, inter alia, vibration is generated or it is impossible to maintain a horizontal state during takeoff and landing, etc., of the aircraft. In addition, because the duct member 30 is capable of moving upward and downward, it is also easy to attach and detach the water-retaining container 10.

In the electrostatic atomization apparatus 1 or the electrostatic atomization method according to Embodiment 1, electrostatic atomization can be performed using moisture in an amount of 100 mL or less for a flight of approximately 24 hours. This is because the insufficiency in the required moisture is refilled from humidity contained in the air. Thus, the amount of moisture used can be less than that in the direct-water-supply-type electrostatic atomization disclosed in Japanese Patent No. 4877410.

In the electrostatic atomization apparatus 1 according to Embodiment 1, electronic equipment such as the electrostatic atomization part 70, the controller 80, and the fan 90 can be disposed above the water-retaining container 10. This reduces a likelihood that water will enter an interior of the electrostatic atomization apparatus 1 even if water leakage occurs, making it possible to suppress a risk of electrical leakage, short-circuiting, etc.

2. Embodiment 2

In Embodiment 2, a water-retaining container 2 that is attachable and detachable from the electrostatic atomization apparatus 1 differs from the water-retaining container 10 in Embodiment 1 by having a partition part 121 to form a wall to partition an interior space of the water-retaining container 2. The water-retaining container 2 is described below, specifically in relation to structures and functions that differ from those of Embodiment 1, with reference to FIGS. 7 to 11. Portions having the same structure and function as in Embodiment 1 are marked with the same reference symbols. Arrow G shown in the drawings indicates the direction of gravity.

2-1. Configuration

Figure 7:
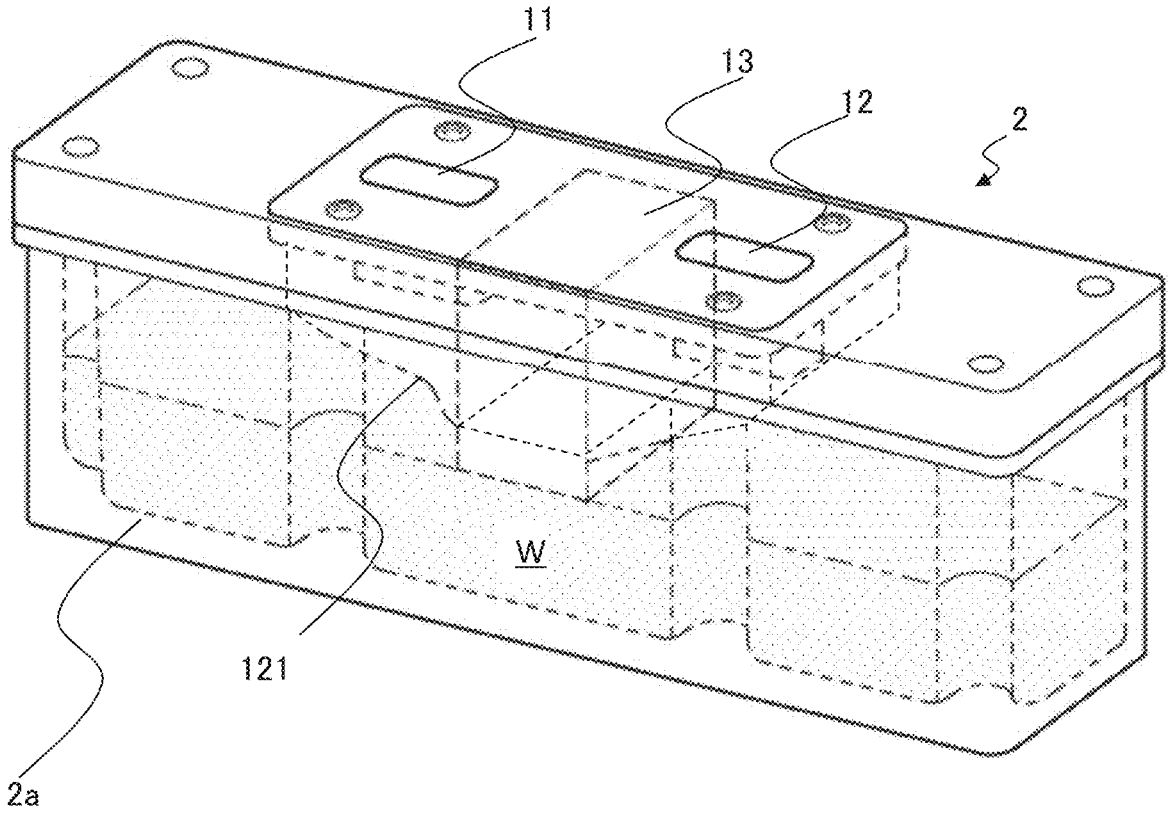
FIG. 7 shows a perspective view of a water-retaining container in Embodiment 2.
Figure 8:
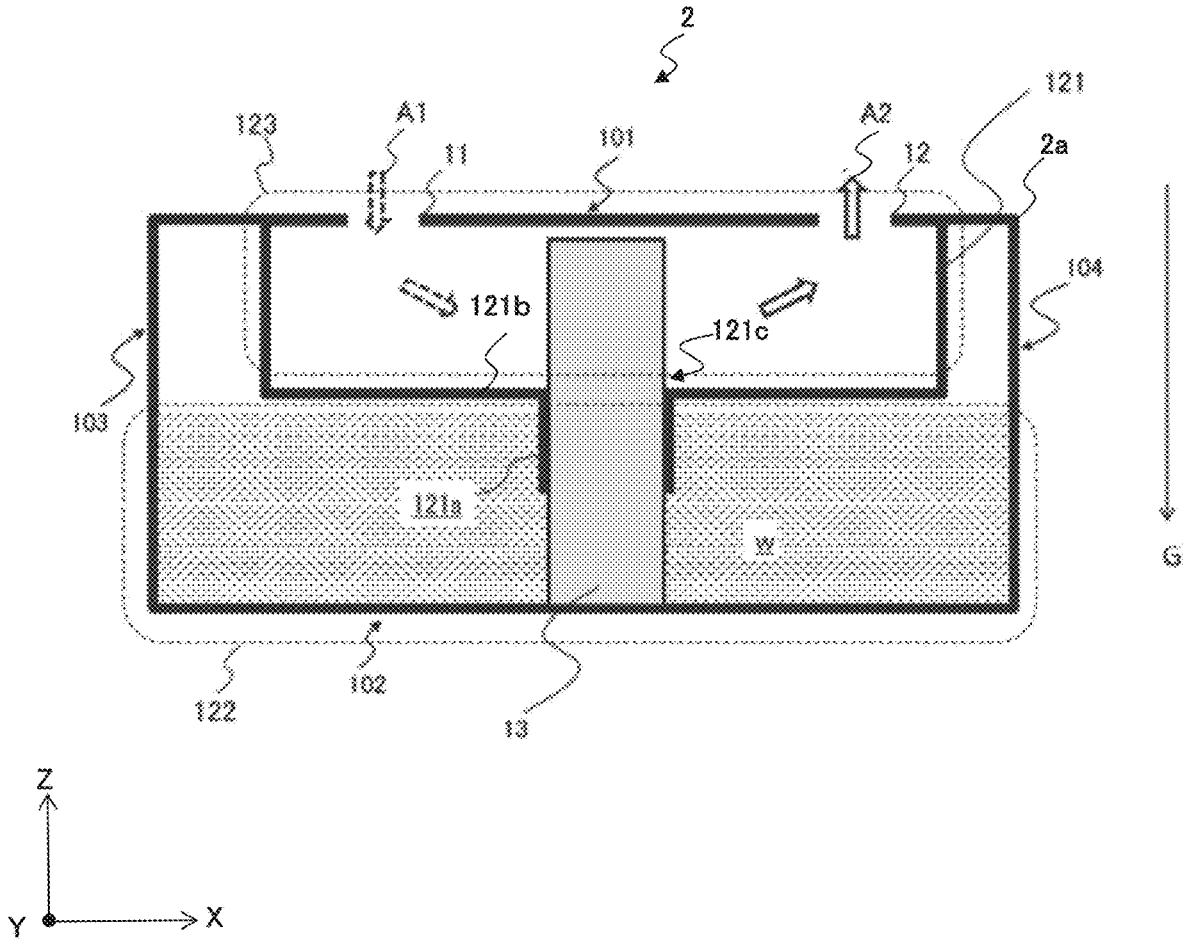
FIG. 8 schematically shows an internal structure of the water-retaining container in Embodiment 2.

As shown in FIGS. 7 and 8, the water-retaining container 2 (one example of a liquid-retaining device) has a container body 2*a* to hold water W. The container body 2*a* (one example of a device body) has an upper part 101, in the same manner as Embodiment 1, a bottom part 102, and left and right container side parts 103, 104 to connect the upper part 101 and the bottom part 102. The upper part 101 of the container body 2*a* may optionally include one or a plurality of lids that can be removed. The lids may optionally be attached via a gasket member (not shown) so that water does not leak from an interior of the container.

The water-retaining container 2 is provided with a first ventilation hole 11 (one example of a first ventilation part) and a second ventilation hole 12 (one example of a second ventilation part), each of which includes a hole that passes through a wall surface of the upper part 101 of the container body 2*a*. The first ventilation hole 11 and the second ventilation hole 12 are arranged so as to be aligned in an X-axis direction. The first ventilation hole 11 introduces air into the container body 2*a*. The second ventilation hole 12 leads the air out of the container body 2*a*.

As shown in FIG. 7, the water-retaining container 2 comprises the partition part 121. As shown in FIG. 8, an interior of the water-retaining container 2 is vertically divided by the partition part 121 into a water-retaining region 122 (one example of a first region) and an airflow passage region 123 (one example of a second region). The first ventilation hole 11 and the second ventilation hole 12, which pass through the upper part 101, communicate with the airflow passage region 123. The partition part 121 has a bottom part 121*b* opposing the water-retaining region 122 in a Z-axis direction. The bottom part 121*b* has a through-hole 121*c* through which the water-retaining region 122 and the airflow passage region 123 communicate and into which a humidifying filter 13 described below is inserted. The partition part 121 has a side surface part 121*a* (one example of a filter-holding part) that protrudes downward from the airflow passage region 123 toward the water-retaining region 122 and surrounds the through-hole 121*c*.

The water-retaining container 2 comprises the humidifying filter 13. The humidifying filter 13 is arranged between the first ventilation hole 11 and the second ventilation hole 12 inside the airflow passage region 123. The humidifying filter 13 is also arranged so as to extend from the water-retaining region 122 to the airflow passage region 123. A lower part of the humidifying filter 13 is arranged inside the water-retaining region 122, and an upper part of the humidifying filter 13 is arranged in an air flow path inside the airflow passage region 123. The humidifying filter 13 is inserted into the through-hole 121*c* of the partition part 121 so as to be closely fitted to the side surface part 121*a*, filling the through-hole 121*c* without leaving any gap. Water absorbed by the lower part of the humidifying filter 13 in the water-retaining region 122 rises by capillary action. The upper part of the humidifying filter 13 inside the airflow passage region 123 thereby holds moisture.

The humidifying filter 13 may optionally be closely fitted to the side surface part 121*a* by using a bond, etc. Alternatively, a gasket member, etc., may optionally be compressed between the humidifying filter 13 and the side surface part 121*a*, filling a space therebetween.

In the water-retaining container 2 of the present embodiment, the first ventilation hole 11 and the second ventilation hole 12 are provided in the upper part 101 of the container body 2*a*; however, the first ventilation hole 11 and the second ventilation hole 12 are not limited to this arrangement. The ventilation holes 11, 12 may optionally be provided in a wall surface in a part other than the upper part 101 (e.g., wall surfaces of the side parts 103, 104) of the container body 2*a*, provided that these holes communicate with the airflow passage region 123.

In the water-retaining container 2 in the present embodiment, the interior of the container is vertically divided so that the airflow passage region 123 is arranged on an upper side and the water-retaining region 122 is arranged on a lower side; however, the water-retaining container 2 is not limited to this arrangement. For example, the water-retaining region 122 may optionally be arranged on the upper side in the interior of the container, and the airflow passage region 123 may be arranged on the lower side. In this case, the first ventilation hole 11 and the second ventilation hole 12 may optionally be provided in lower wall surfaces of the side parts 103, 104, respectively, so as to communicate with the airflow passage region 123. Alternatively, the water-retaining region 122 may optionally be arranged on one of left and right sides of the interior of the container, and the airflow passage region 123 may optionally be arranged on the other of the left and right sides of the interior of the container. In this case, the first ventilation hole 11 and the second ventilation hole 12 may optionally be provided in a wall surface of the upper part 101 and a wall surface of one of the side parts 103, 104, respectively, so as to communicate with the airflow passage region 123.

The water-retaining container 2 is used by being detachably attached to the body part 1*a* of the electrostatic atomization apparatus 1 of Embodiment 1. The water-retaining container 2 may optionally be attached to the body part 1*a* of the electrostatic atomization apparatus 1 via a connection part such as the duct member 30 (FIGS. 3 and 5) of Embodiment 1.

The airflow generated by the fan 90 shown in FIG. 1 is introduced via the first ventilation hole 11 into the airflow passage region 123. The air introduced into the airflow passage region 123 passes through the upper part of the humidifying filter 13, which holds moisture. The air that has been humidified by passing through the humidifying filter 13 is led out from the second ventilation hole 12 by the airflow.

The water-retaining container 2 according to the present embodiment, and according to modified examples 1 and 2 and other embodiments described below, is not limited to being applied to the electrostatic atomization apparatus 1, but may also optionally be applied to a humidifying apparatus. In this case, the humidified air from the second ventilation hole 12 is discharged from a discharge opening similar to the discharge opening 22*b* shown in FIG. 1.

2-2. Characteristics

In an aircraft, etc., vibration is constantly generated while the aircraft is moving, and there are cases where it is impossible to maintain a horizontal state during takeoff and landing. Therefore, the water-retaining container 2 attached to the electrostatic atomization apparatus 1 or a humidifying apparatus becomes tilted, or the water W undulates or leaps upward. As a result, there is a possibility that the surface of the accommodated water W will change, or that the water W will leak out from the first ventilation hole 11 and the second ventilation hole 12 in the water-retaining container 2 to the outside. This would cause electrical leakage, short-circuiting, etc., in the electrostatic atomization apparatus 1 or the humidifying apparatus. Furthermore, when the water-retaining container 2 is removed from the electrostatic atomization apparatus 1 or the humidifying apparatus and handled as a separate unit, consideration must be given to leakage of water W to the outside resulting from the container falling or from vibration produced by handling. Because the first ventilation hole 11 and the second ventilation hole 12 in the water-retaining container 2 are airflow paths, as described in Embodiment 1, it is necessary to keep the ventilation holes 11, 12 open during running of the electrostatic atomization apparatus 1 or the humidifying apparatus.

In the water-retaining container 2 according to Embodiment 2, the partition part 121 is present in the interior of the container, and the humidifying filter 13 linking the water-retaining region 122 and the airflow passage region 123 is arranged so as to be closely fitted to the partition part 121. Thus, even when the water-retaining region 122 is filled with water, the water W cannot in any large amount infiltrate the airflow passage region 123, which is in an upper part from the water-retaining region 122. Thus, it is possible to suppress the risk of electrical leakage, short-circuiting, etc., in the electrostatic atomization apparatus 1 or the humidifying apparatus. At the same time, because the first ventilation hole 11 and the second ventilation hole 12 in the water-retaining container 2 are kept open, the flow path of the airflow for electrostatic atomization or humidification is secured.

Since the water-retaining container 2 according to Embodiment 2 has a structure in which water leakage does not readily occur, the risk of occurrence of electrical leakage, short-circuiting, etc., due to water leakage is suppressed and safety is enhanced in an aircraft environment in which electronic equipment is present in each of multiple adjacent areas.

Furthermore, the water-retaining container 2 according to Embodiment 2 can generate and send humidified air as a separate unit.

2-3. Modified Examples

2-3-1. Modified Example 1

Figure 9:
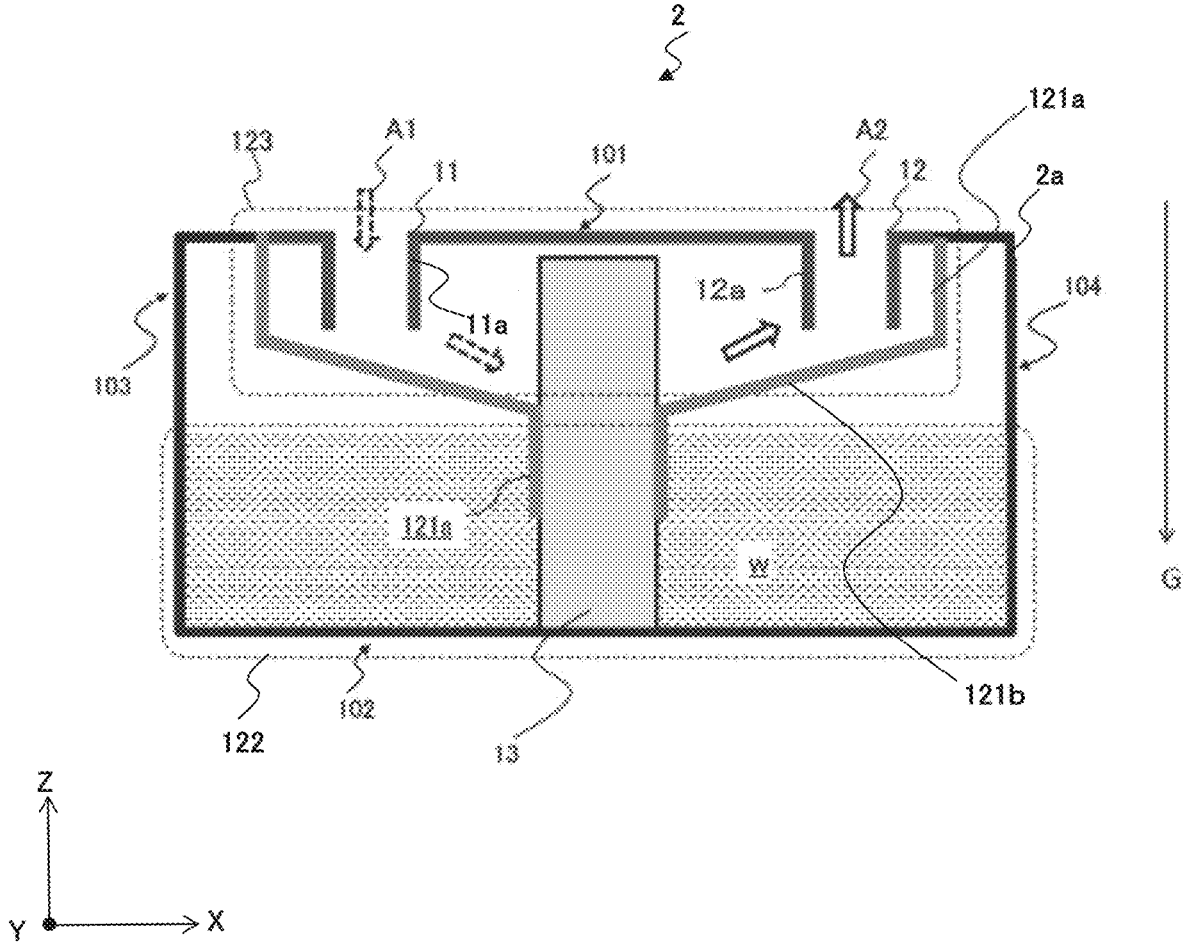
FIG. 9 schematically shows an internal structure of a water-retaining container according to a modified example 1 of Embodiment 2.

FIG. 9 shows a water-retaining container 2 according to modified example 1. The water-retaining container 2 comprises tubular wall parts 11*a*, 12*a* that extend downward from the first ventilation hole 11 and the second ventilation hole 12 and that surround the respective holes. The wall parts 11*a*, 12*a* constitute a valve structure to stop water. Therefore, it is possible to prevent water from leaking from the first ventilation hole 11 and the second ventilation hole 12 even when the water-retaining container 2 removed from the electrostatic atomization apparatus 1 is placed upside down in a state in which water has infiltrated the airflow passage region 123.

Also, in the water-retaining container 2, the bottom part 121*b* of the partition part 121 is inclined from the airflow passage region 123 toward the water-retaining region 122, i.e., downward. Provided that the water-retaining container 2 is in a state of being disposed right-side up (e.g., a state in which the water-retaining container 2 is attached in the electrostatic atomization apparatus 1) as shown in FIG. 9, the water thereby flows in the direction of the humidifying filter 13 even when the water infiltrates the airflow passage region 123. Therefore, it is possible to efficiently collect the water in the humidifying filter 13 and to suppress an amount of water that leaks to the outside.

2-3-2. Modified Example 2

When the water-retaining container 2 is handled as a separate unit, i.e., is not attached to the body part 1*a* of the electrostatic atomization apparatus 1, there is a concern that even a slight amount of water leaking out into the airflow passage region 123 could leak from the first ventilation hole 11 and the second ventilation hole 12.

Figure 10:
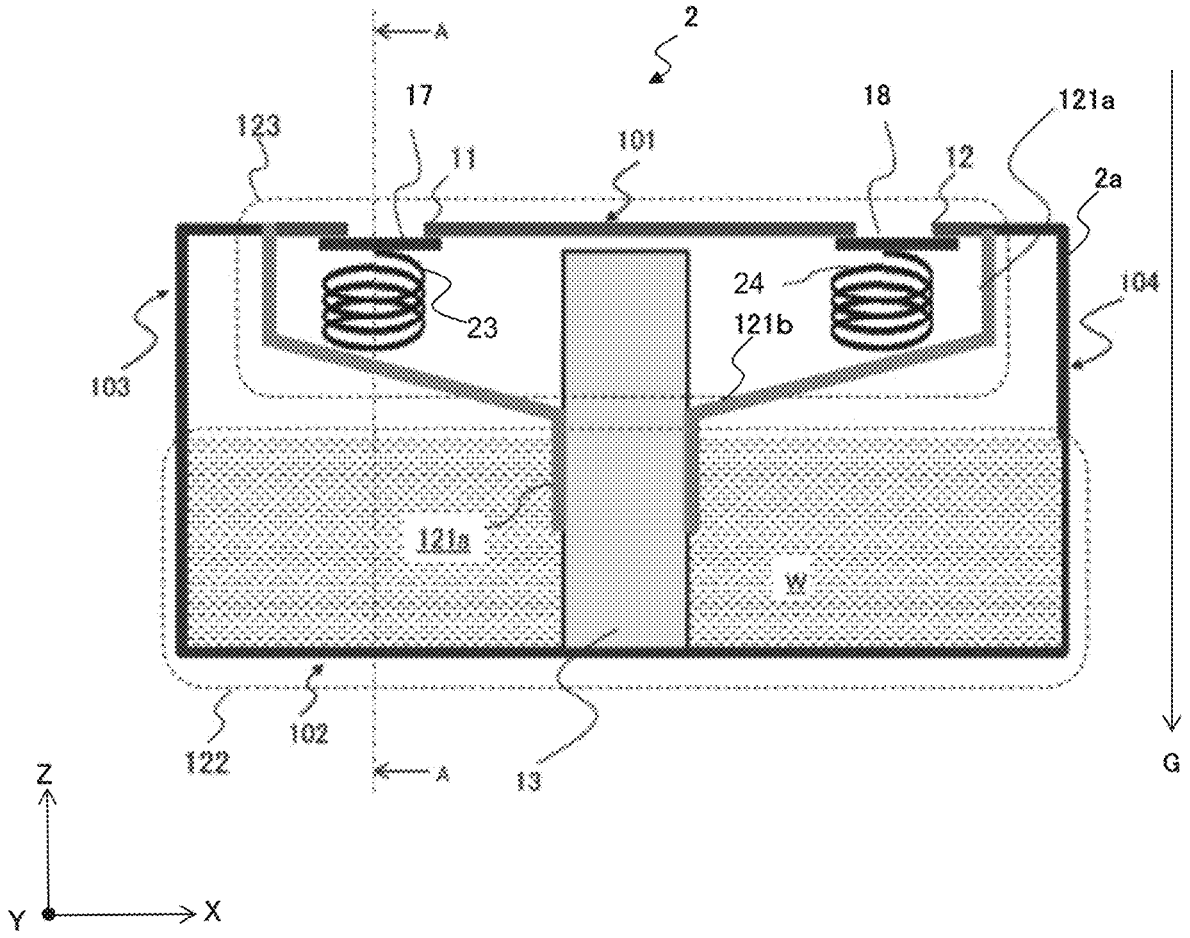
FIG. 10 is a top view of a water-retaining container according to a modified example 2 of Embodiment 2.

In order to prevent this, the water-retaining container 2 comprises a first lid member 17 and a second lid member 18 that are capable of opening and closing the first ventilation hole 11 and the second ventilation hole 12, as shown in FIG. 10, the first lid member 17 and the second lid member 18 serving as mechanisms for further suppressing water leakage. Furthermore, the water-retaining container 2 comprises an opening/closing mechanism to open the first ventilation hole 11 when the water-retaining container 2 is attached to the body part 1*a* of the electrostatic atomization apparatus 1 and to close the first ventilation hole 11 when the water-retaining container 2 is removed from the body part 1*a* of the electrostatic atomization apparatus 1. Similarly, the water-retaining container 2 comprises an opening/closing mechanism to open the second ventilation hole 12 when the water-retaining container 2 is attached to the body part 1*a* of the electrostatic atomization apparatus 1 and to close the second ventilation hole 12 when the water-retaining container 2 is removed from the body part 1*a* of the electrostatic atomization apparatus 1. The opening/closing mechanisms are implemented through, e.g., the following configuration.

The first lid member 17 and the second lid member 18 have a structure in which, when the water-retaining container 2 is removed from the body part 1*a* of the electrostatic atomization apparatus 1, the lid members 17, 18 are pushed upward by springs 23, 24 so as to close. The springs may optionally be coil springs, torsion springs, leaf springs, or another such spring structure. Gaps between the upper part 101 of the container body 2*a* and the first lid member 17 and second lid member 18 may optionally be filled by a cushion material, etc.

Figure 11A:
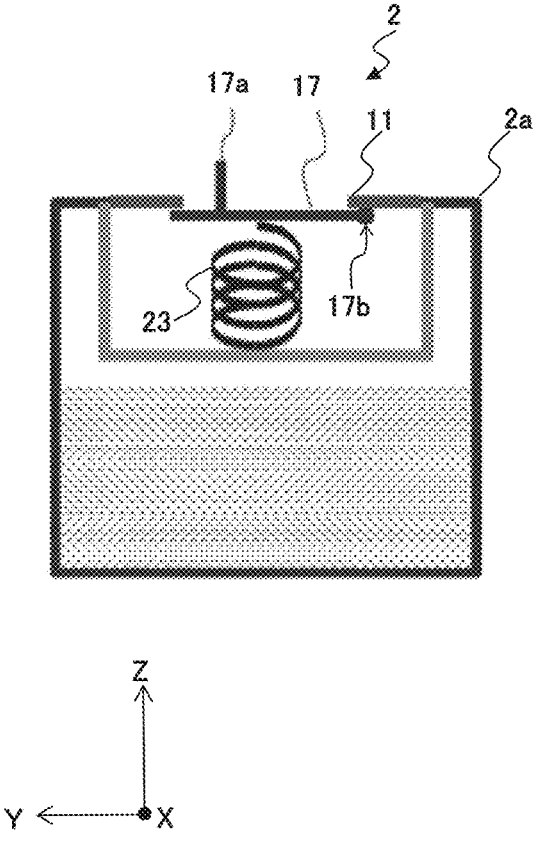
FIG. 11A is a cross-sectional view showing the water-retaining container in FIG. 10 from a different direction.
Figure 11B:
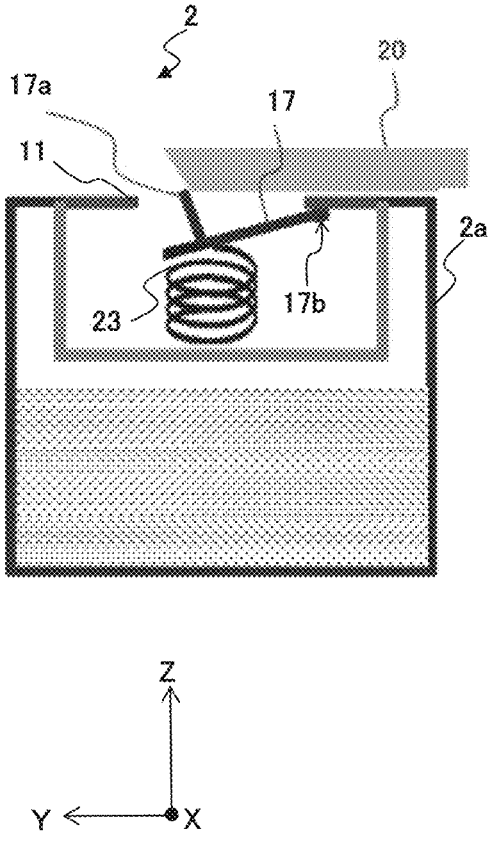
FIG. 11B is a cross-sectional view showing the water-retaining container in FIG. 10 from a different direction, and showing a state in which the water-retaining container is attached to a humidifying apparatus.

FIGS. 11A and 11B show Y-direction cross-sections of the water-retaining container 2. The first lid member 17 is provided with a protrusion 17*a* that extends upward and a fulcrum 17*b*, the first lid member 17 being capable of turning about the fulcrum 17*b*. FIG. 11A shows a state of the lid member 17 when the water-retaining container 2 is not attached to the body part 1*a* of the electrostatic atomization apparatus 1. A negative direction of the Y axis indicates an attachment direction of the body part 1*a* of the electrostatic atomization apparatus 1. A protrusion 20 is provided to the body part 1*a* of the electrostatic atomization apparatus 1. When the water-retaining container 2 is attached to the body part 1*a* of the electrostatic atomization apparatus 1, the protrusion 17*a* of the first lid member 17 is pushed in a positive direction of the Y axis by the protrusion 20, as shown in FIG. 11B. The first lid member 17 thereby turns about the fulcrum 17*b* in a direction to open the first ventilation hole 11. The second lid member 18 also is provided with the same configuration, opening and closing the second ventilation hole 12 by a similar turning.

According to the present modified example, when the water-retaining container 2 is attached to the body part 1*a* of the electrostatic atomization apparatus 1, the air flow path for electrostatic atomization is secured. When the water-retaining container 2 is removed from the body part 1*a* of the electrostatic atomization apparatus 1, the first ventilation hole 11 and the second ventilation hole 12 are closed.

Therefore, even when the water-retaining container 2 is handled as a separate unit, it is possible to achieve a water-stopping function that can sufficiently withstand even strong vibrations and falling.

3. Other Embodiments

As indicated above, the above embodiments are described as examples of features disclosed in the present application. However, the features in the present disclosure are not limited thereto and can also be applied to embodiments in which modifications, substitutions, additions, deletions, etc., have been made, as appropriate. The constituent elements described in the above embodiments can also be combined to create new embodiments. In the above embodiments, the water-retaining container 10, 2 accommodates water; however, the water-retaining container 10, 2 may optionally accommodate another liquid.

General Interpretation of Terms

In understanding the scope of the present disclosure, the term "configured" as used herein to describe a component, section, or a part of a device includes hardware and/or software that is constructed and/or programmed to carry out the desired function.

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms "including," "having," and their derivatives. Also, the terms "part," "section," "portion," "member," or "element" when used in the singular can have the dual meaning of a single part or a plurality of parts. Also as used herein to describe the above embodiment(s), the following directional terms "forward", "rearward", "above", "downward", "vertical", "horizontal", "below" and "transverse" as well as any other similar directional terms refer to those directions of a device. The term "circumference" and its derivatives may include a distance or measurement around an outside or an inside of a circle, any other round shape, or any polygonal shape.

Terms that are expressed as "means-plus function" in the claims should include any structure that can be utilized to carry out the function of that part of the present disclosure. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected exemplary embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed:

1. A humidifier comprising:

a liquid-retainable device, the liquid-retainable device including:

a container capable of accommodating a liquid;

a first ventilation part including a first hole passing through a wall surface of the container, the first hole being configured to introduce air;

a second ventilation part including a second hole passing through the wall surface of the container, the second hole being configured to let out the air;

a partition part dividing an interior of the container into a first region and a second region arranged on an upper side of the first region, the first region being a region for accommodating the liquid, and the second region being a region for forming an air flow path between the first ventilation part and the second ventilation part; and a humidification filter arranged so as to extend from the first region to the second region, wherein the humidifier further comprises:

a housing;

a body part which is inside the housing;

a connector configured to connect the liquid-retainable device to the humidifier;

an airflow generator that is arranged in the body part, the airflow generator being configured to generate an airflow passing through the air flow path; and a discharge opening that is arranged in the body part, the discharge opening being configured to discharge humidified air through the air flow path, and wherein:

the container is configured to be attached to and detached from the body part;

a first part of the humidification filter is arranged inside the first region;

a second part of the humidification filter is arranged in the air flow path inside the second region;

an entirety of the humidification filter is arranged inside the container; and an entirety of the container is arranged inside the housing.

2. The humidifier according to claim 1, wherein:

the first ventilation part and the second ventilation part communicate with the second region.

3. The humidifier according to claim 1, wherein:

the partition part has a bottom part opposing the first region; and the bottom part is inclined from the second region toward the first region.

4. The humidifier according to claim 1, wherein:

each of the first ventilation part and the second ventilation part has a wall part that extends toward the second region;

the wall part of the first ventilation part is configured to surround the first hole; and the wall part of the second ventilation part is configured to surround the second hole.

5. The humidifier according to claim 1, further comprising:

a first lid member that is capable of opening and closing the first ventilation part;

a first opener configured to: (i) open the first ventilation part when the liquid-retainable device is attached to the humidifier; and (ii) close the first ventilation part when the liquid-retainable device is removed from the humidifier;

a second lid member that is capable of opening and closing the second ventilation part; and a second opener configured to: (i) open the second ventilation part when the liquid-retainable device is attached to the humidifier; and (ii) close the second ventilation part when the liquid-retainable device is removed from the humidifier.

6. The humidifier according to claim 5, wherein:

the first opener includes a first spring configured to push the first lid member so as to close a first airflow path including the first ventilation part; and the second opener includes a second spring configured to push the second lid member so as to close a second airflow path including the second ventilation part.

7. The humidifier according to claim 6, wherein:

the first lid member includes a fulcrum and a protrusion that extends upward; and the protrusion of the first lid member is configured to be pushed by a protrusion of the body part such that the first lid member turns about the fulcrum so as to open the first ventilation part.

8. The humidifier according to claim 7, wherein:

the first spring is a coil spring configured to push a medial portion of the first lid member.

9. The humidifier according to claim 6, wherein:

the first spring is a coil spring configured to push a medial portion of the first lid member; and the second spring is a coil spring configured to push a medial portion of the second lid member.

10. The humidifier of claim 1, further comprising:

a spring arranged between the body part and the connector, and configured to push the connector to the liquid-retainable device; and a protruding part protruding from a surface of the connector facing the liquid-retainable device, wherein the liquid-retainable device further comprises a recessed part that is recessed from a surface of the liquid-retainable device facing the connector and engaged with the protruding part.

11. The humidifier according to claim 10, wherein:

the connector includes a hole configured to communicate with the first ventilation part and introduce the air from the humidifier, and a hole configured to communicate with the second ventilation part and let out the air.

12. The humidifier of claim 1, further comprising:

a spring arranged between the body part and the connector, and configured to push the connector to the liquid-retainable device; and a recessed part that is recessed from a surface of the connector facing the liquid-retainable device, wherein:

the liquid-retainable device further comprises a protruding part protruding from a surface of the liquid-retainable device facing the connector and being engaged with the recessed part; and the spring gives an urging force to the protruding part in a direction from the protruding part to the recessed part.

13. The humidifier according to claim 12, wherein:

the connector includes a hole configured to communicate with the first ventilation part and introduce the air from the humidifier, and a hole configured to communicate with the second ventilation part and let out the air.

14. The humidifier according to claim 1, wherein:

the partition part has a through-hole by which the first region and the second region communicate and into which the humidification filter is inserted.

15. The humidifier according to claim 14, wherein:

the partition part has a filter-holding part that protrudes from the second region toward the first region and surrounds the through-hole; and the humidification filter is fitted to the filter-holding part so as to fill the through-hole without leaving any gap.

16. The humidifier according to claim 1, wherein the container is attached to the body part.

* * * * *